United States Patent [19]

Guerriero et al.

[11] Patent Number: 4,838,709

[45] Date of Patent: Jun. 13, 1989

[54] PORTABLE CASE FOR COMPUTER INFORMATION STORAGE MATERIALS

[76] Inventors: Jean R. Guerriero, 124 Sheldon Ave., Pittsburgh, Pa. 15220; Melinda M. Carbonara, 535 Brazil St., Pittsburgh, Pa. 15227

[21] Appl. No.: 197,202

[22] Filed: May 23, 1988

[51] Int. Cl.[4] ..... B65D 33/06

[52] U.S. Cl. ..... 383/18; 383/97; 190/119; 206/444; 150/107

[58] Field of Search ..... 190/111, 119, 113–118; 383/97, 24, 17, 15, 18; 206/391, 394, 8, 444; 150/107–110

[56] References Cited

U.S. PATENT DOCUMENTS

| | | | |
|---|---|---|---|
| 1,691,904 | 11/1928 | Gamble | 206/8 X |
| 1,691,905 | 11/1928 | Gamble | 383/15 X |
| 1,771,168 | 7/1930 | Droutman | 383/15 X |
| 2,444,511 | 7/1948 | Kaufmann | 190/119 |
| 2,490,222 | 12/1949 | Lowe | 383/24 X |
| 2,672,962 | 3/1954 | Keirsey | 190/115 |
| 3,447,649 | 6/1969 | Kish, Jr. | 190/111 |
| 3,994,372 | 11/1976 | Geller et al. | 383/18 X |
| 4,167,175 | 9/1979 | Malafouris | 150/52 R |
| 4,298,104 | 11/1981 | Leong | 383/15 |
| 4,334,601 | 6/1982 | Davis | 190/111 X |
| 4,693,344 | 9/1987 | Shuler | 190/111 X |
| 4,703,519 | 10/1987 | Krenzel | 383/97 |

FOREIGN PATENT DOCUMENTS

| | | | |
|---|---|---|---|
| 542152 | 11/1955 | Belgium | 150/52 R |
| 558341 | 6/1958 | Canada | 190/119 |
| 821264 | 8/1937 | France | 190/119 |
| 968005 | 11/1950 | France | 383/18 |
| 1050407 | 9/1953 | France | 190/119 |
| 1119990 | 4/1956 | France | 206/8 |
| 2394268 | 1/1979 | France | 150/110 |
| 691689 | 7/1965 | Italy | 190/111 |
| 813414 | 5/1959 | United Kingdom | 383/18 |

*Primary Examiner*—William Price

*Attorney, Agent, or Firm*—Harry Williams

[57] ABSTRACT

A portable case or bag for transporting computer storage materials such as computer tapes and printout sheets in which the case defines an interior space which is substantially the size and shape of the material to be transported and in which a pair of parallel loop-like straps, each of which extend in a single plane, substantially surround and support the case and provide a handle means where they leave the case; a closure means is disposed between the loop-like straps. Also, a marker sheet is provided as an integral part of that embodiment of the case which is used for transporting computer printout sheets; the marker sheet is provided with a relatively inflexible straight edge as a reading guide for the printout sheets.

4 Claims, 2 Drawing Sheets

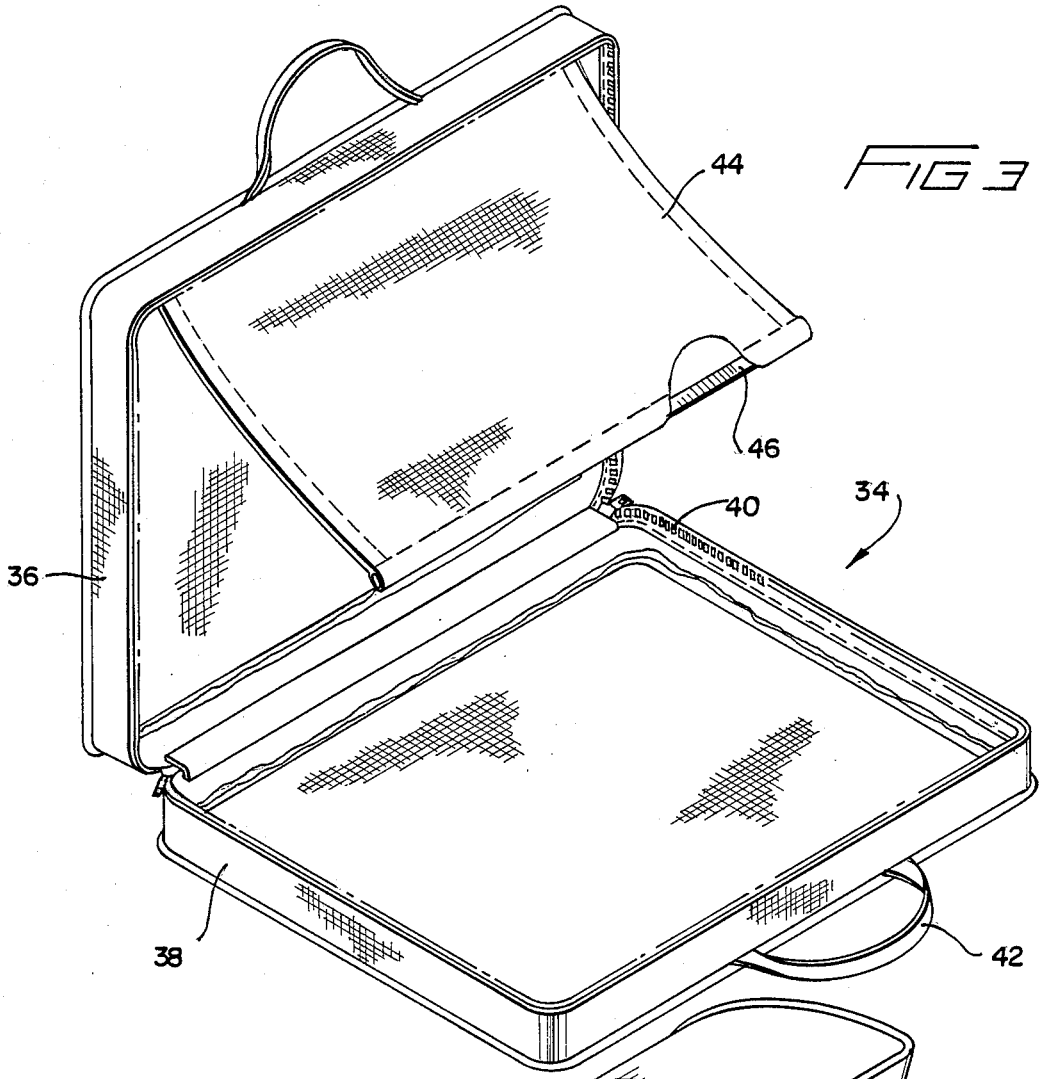
FIG 3
FIG 4
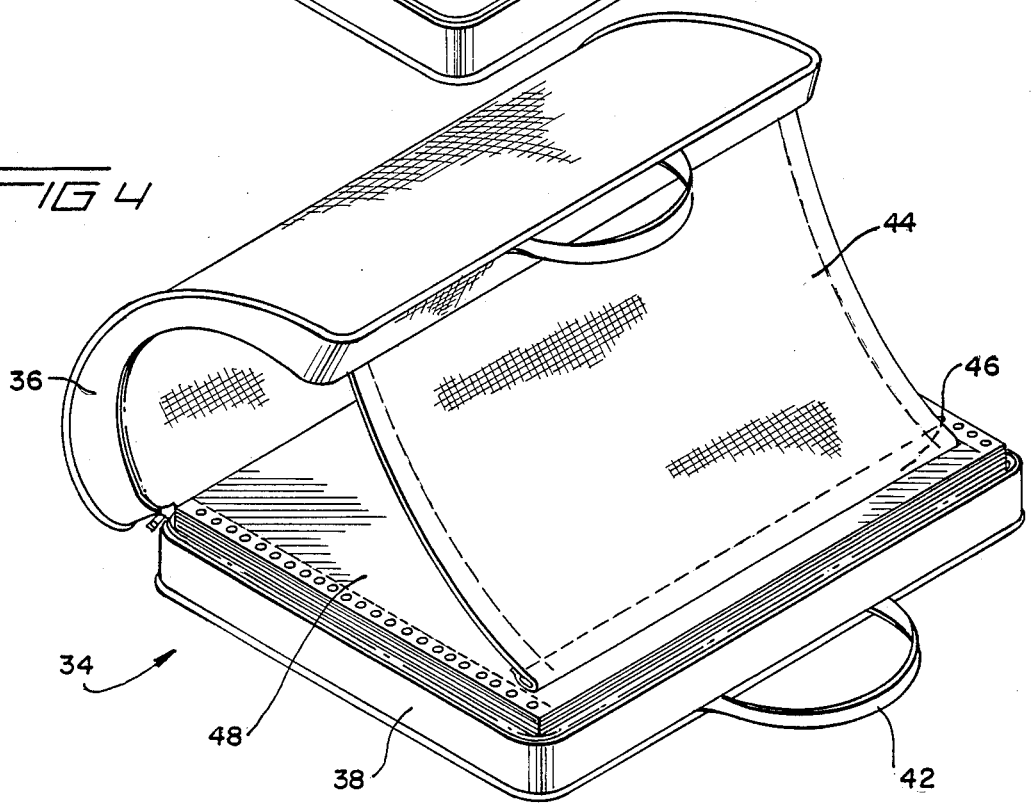

PORTABLE CASE FOR COMPUTER INFORMATION STORAGE MATERIALS

FIELD OF THE INVENTION

This invention relates to portable carrying cases or bags for the transportation of a specific kind of material, particularly computer information storage materials.

BACKGROUND OF THE INVENTION

The advent of computers today in almost every field of business and technology has brought with it the advent, as well, of a host industry for computer support materials and services. One area in which these support services are required is in the transportation of materials to and from the computer system at the computer work site. There has been, however, little or not advance made in the area of carrying cases or bags for transporting quite common computer supply materials, particularly computer tapes and reels and information-bearing computer printout sheets. For example, a computer system at a work site might have an input component or a storage component which uses computer tape wound on reels or the like, which reels have to be manually transported to the computer work site. The same conditions (but in reverse) apply to the transportation of materials or supplies from the computer work site (to another work site usually), particularly the printout sheets that issue from computer printout components. At present, such tape-reels and printout sheets are inefficiently transported to and from the computer work site, either loosely or in bags or cases which are not designed to carry such materials.

There is a need, therefore, to provide special purpose carrying bags or cases for computer tapes and printout sheets, in other words a need for providing carrying cases whose purpose it would be to effectively and efficiently support the computer system itself, that is, efficiently support the in-flow to and the out-flow from such a system. Such bags or cases should conform to the requirements of the particular item to be transported; and each case should be quite special to the specific item for which it was designed and should, therefore, take into account such factors as ease of handling, accessibility to the interior of the case, easy and effective manipulation of the materials carried in the case, as well as the efficient and economic use of materials for the construction of such cases.

SUMMARY AND OBJECTS OF THE INVENTION

It is the primary purpose of the present invention to address the aforementioned needs by providing portable carrying cases or bags which can efficently carry computer tape reels on the one hand and computer printout sheets on the other. The portable cases according to the present invention eliminate the defects inherent in prior methods of handling tape-reels and printout sheets as mentioned above, and by virtue of their novel construction they serve to effectively support the computer system itself for both the in-flow of materials to and the out-flow of materials from that system.

The present invention has for its ancilliary objects and benefits the provision of a strongly constructed portable case for transporting computer tapes or printout sheets in which these materials can be easily handled in being placed in the case or taken from the case. The strength of construction and ease of handling of the case, according to the invention, is enhanced by the provision of a unique handle and interior access assembly that allows the case, in one embodiment of the invention, to be opened from the bottom and carried from the top. Additionally, in the case of transporting computer printout sheets, the case according to the present invention can be opened during transport and the printout sheets can be worked on with the aid of a unique marker sheet and reading guide that is integral with the case.

The portable cases according to the invention are preferrably constructed from a pliable material that defines an interior space which is substantially the size and shape of the material to be transported—a cylinder in the case of computer tape reels and a rectangle in the case of computer printout sheets. A unique handle and support feature afforded by the present invention calls for the provision of a pair of parallel loop-like straps or strips, each of which extend in a single plane and substantially surround the case where attached to it and provide a handle means where they are unattached. A zipper or equivalent opening and closing means is disposed between the loop-like straps and extends parallel to the straps to allow accessibility to the interior of the case. In the rectangular-shaped case for transporting computer printout sheets, a marker sheet is also provided as an integral part of the case. The marker sheet is approximately the size of a single printout sheet and therefore can be placed between the sheets of a package of such sheets being transported, should it be desirable to mark the place where one has left off from working on the sheets during transport. Also, the marker sheet is provided with a relatively inflexible straight edge for enabling the user to use the marker as a reading guide for lining up a row of indicia, say, on a particular printout sheet.

The invention will be better understood as well as further objects and advantages thereof become more apparent from the ensuing detailed description of the preferred embodiments taken in conjunction with the drawings.

BRIEF DESCRIPTION OF THE DRAWINGS

FIG. 3 is a schematic perspective showing a second embodiment of the invention;

FIG. 4 is a schematic illustration of the case shown in FIG. 3;

DETAILED DESCRIPTION OF THE PREFERRED EMBODIMENTS

Figure 1:
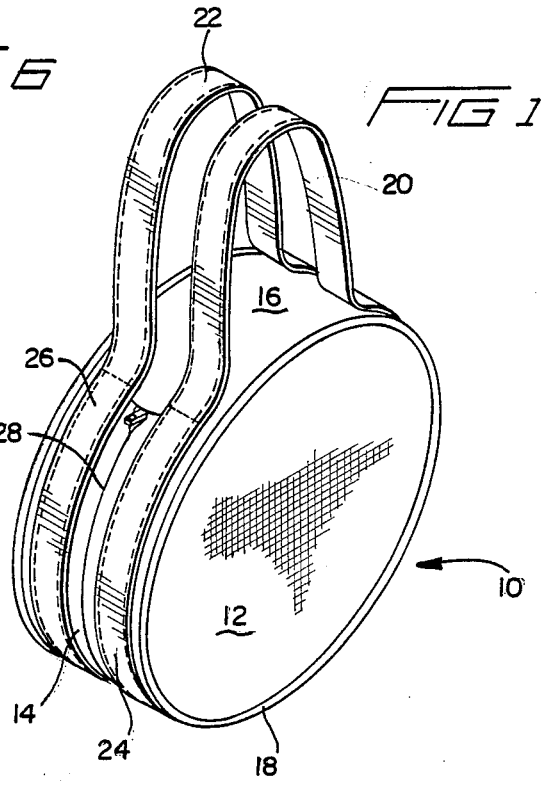
FIG. 1 is a schematic perspective view of a first embodiment of the invention.

Referring now to FIG. 1, there is shown a case 10 according to the principles of the invention for carrying computer tape reels. The shape of the case is generally cylindrical and conforms to the size and shape of standard computer tape reels and their associated containers known throughout the industry. The case 10 is seen to have sidewalls 12 and a round wall 14 therebetween which may be formed from a pliable material, such as a flexible fabric. However, it is well within the scope of the invention to have the case 10 formed from an inflexible material, such as a plastic or a metal or a compound thereof, or a plasticized fabric or the like The round wall 14 is provided with a seam 28 disposed centrally thereof which runs circumferentially around the wall 14 except in that portion of the wall marked 16. Two loop-like straps 24, 26 are seen to surround the round wall 14 in a spaced apart and parallel relationship with one another, so that each strap extends in its own single plane. Each of the straps 24, 26 are attached to the case by stitching or other suitable means in that area where the seam 28 runs its full course, that is, the major circumferential portion of the round wall 14, except for the area marked 16. It will be seen that the straps 24, 28 leave the case, that is, become unattached where the seam 28 begins and ends to thereby form handle portions 20, 22 which overly the area 16.

Figure 2:
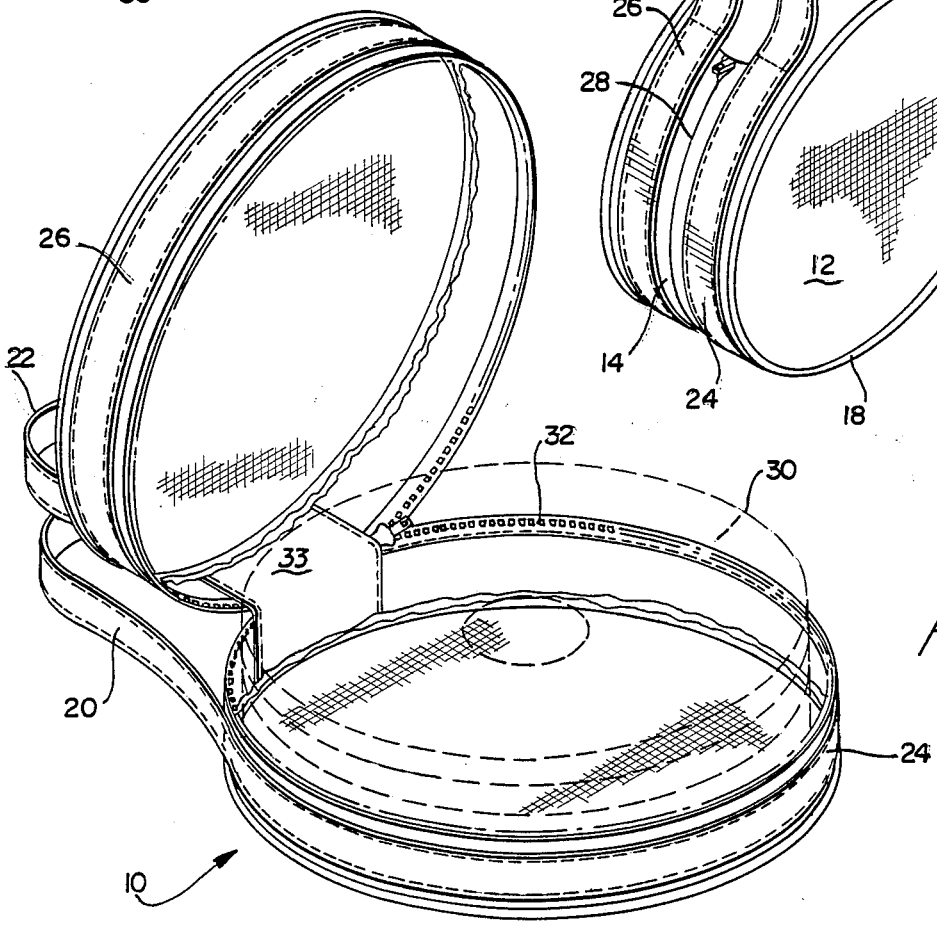
FIG. 2 is a schematic illustration showing the interior of the case shown in FIG. 1.

As seen in FIG. 2, the case 10 is opened to show a stack of computer tapes 30, shown in phantom, disposed therein. A zipper 32 is shown for the purpose of closing and opening the seam 28 (see FIG. 1). Obviously another form of closure means could be provided, such as VELCRO closure or a suitable snap fastener means, not shown. A reinforcing strip of material 33 underlies the area 16 (see FIG. 1) and serves to reinforce the "hinge" area of the case. Where the case 10 is constructed from an inflexible material, such as plastic or metal, this strip 33 would act as the hinge for the case, and the seam 28, naturally, would completely traverse the round wall 14 so that a full circle is formed by the seam. It is also contemplated that a small hinge, not shown, be provided in place of the reinforcing strip 33 in this last instance to serve as a pivotal means between the two halves of the case.

From the foregoing it will be seen that the case 10 can be easily opened by operating the zipper 32, for example, so that the two halves of the case open about the area 16 of the round wall 14. In this way the interior space of the case is made accessible without interference from the handle portion of the case, and the computer tapes can then be easily lifted from the case or placed into the case without obstruction. Once the case is zipped shut, the loop-like straps 24, 26 completely surround the bottom of the case and the tapes contained therein, insuring maximum support.

In FIG. 3 a further embodiment of the invention is shown, wherein a conventional case 34 is provided which is shown to be the size and shape of the conventional size and shape of computer printout sheets 48 (see FIG. 4). According to the invention there is provided a flexible marker sheet 44 which is attached to the inside of the case at the upper edge thereof just opposite the handle 42. The marker sheet 44 is also provided with a straight edge member 46 occupying a suitable pocket provided at the bottom portion of sheet 44, as shown.

In FIG. 4 the printout sheets 48 are shown stacked inside the case 34, and the marker sheet 44 is shown with its bottom edge lying on top of a single printout sheet. This edge, which is relatively inflexible because of the member 46, can then be used to line up rows of indicia on the printout sheet when the user of the case wishes to work on the material on the printout sheets during transport. For example, the case according to the invention might be placed on the user's knees when he or she is sitting in an airplane, train, or other public or private conveyance, at which time the case can be opened, the material therein studied or read, using the marker sheet as a reading guide, and then when it is time to leave the conveyance the marker sheet can then be left on the last page worked on to mark where the user had left off reading.

Figure 5:
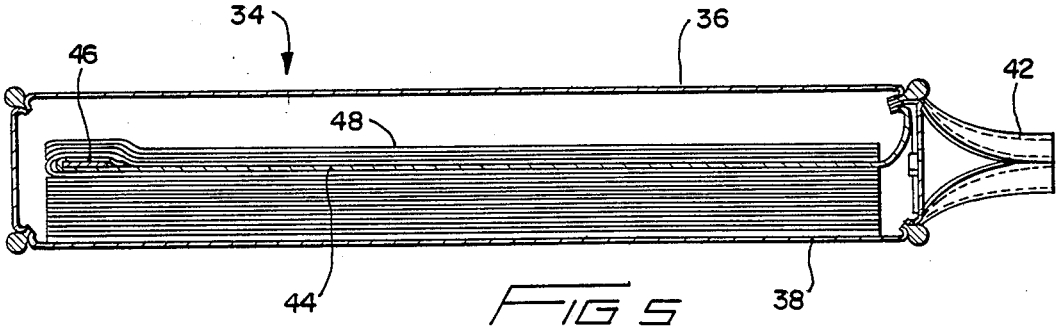
FIG. 5 is a schematic cross-sectional view of the case shown in FIGS. 3 and 4.

FIG. 5 shows the case of FIGS. 3 and 4 in a closed position with the printout sheets 48 stacked therein and the marker sheet 44 suitably inserted between the sheets to mark off the place where the user had last worked on them.

Figure 6:
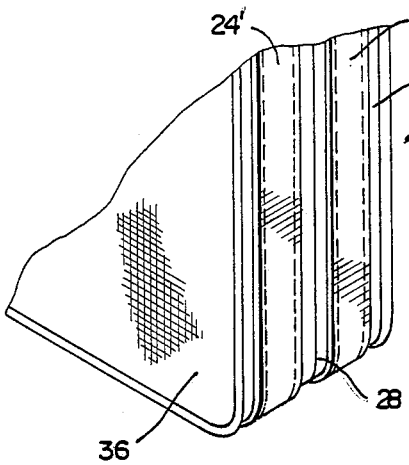
FIG. 6 is a partial perspective view of the case shown in FIG. 3 employing the principles of construction of the case shown in FIG. 1.

FIG. 6 shows a portion of the case shown in FIGS. 3 and 4, wherein the construction of the case conforms to the principles used in the case shown in FIG. 1. In this instance the case is defined by the two half portions 36, 38 (as in FIGS. 3 and 4). Here, however, the straps 24' and 26', corresponding to the straps 24, 26 shown in FIG. 1, are seen to surround the two halves, respectively, of the case 34. In this particular case the handle is similar to that shown for the case in FIG. 1. Such a construction could be used in a case where the thickness or width is greater than that for the conventional, relatively thinner case, such as shown in FIGS. 3 and 4, where the thinness of such a case would not warrant the kind of construction afforded by the present invention. The embodiment shown in FIG. 6, then, combines the inventive features of the cases discussed above and shown in FIGS. 1, 2, 3 and 4.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A portable case for transporting computer information storage materials, comprising a pair of spaced apart closed loop members affixed to and circumscribing a major dimension of said case, each of said loop members extending in a single plane parallel to and separate from the plane of the other loop member, a handle means formed by said loop members where said loop members are not affixed to said case, and an elongated closure means disposed between said loop members and being parallel thereto where said loop members are affixed to said case, whereby said elongated closure means is disposed on said case generally opposite to that portion of said case bounded by said handle means where said loop members are not affixed to said case.

2. A portable case of a generally cylindrical shape having a rim portion and generally circular side portions for transporting computer information storage materials, comprising a pair of spaced apart closed loop members affixed to and circumscribing a major portion of said rim portion of said case, each of said loop members extending in a single plane parallel to and separate from the plane of the other loop member, a handle means formed by said loop members where said loop members are not affixed to said rim portion of said case, and an elongated closure means disposed between said loop members on said rim portion of said case where said loop members are affixed to said rim portion, whereby said elongated closure means is disposed on said rim of said case diametrically opposite to that portion of said rim of said case bounded by said handle means where said loop members are not affixed to said rim.

3. A portable case of a generally cylindrical shape having a rim portion and generally circular side portions for transporting computer information storage materials, comprising a pair of spaced apart closed loop members affixed to and circumscribing a major portion of said rim portion of said case, each of said loop members extending in a single plane parallel to and separate from the plane of the other loop member, a handle means formed by said loop members where said loop members are not affixed to said rim portion of said case, an elongated closure means disposed between said loop members and being parallel thereto on said rim portion of said case where said loop members are affixed to said case, and a hinge portion of said rim of said case formed where said loop members are not affixed to said rim portion, said hinge portion being in the vicinity of and bounded by said handle means, whereby said case may be opened or closed about said hinge portion.

4. A portable case according to claim 3, wherein said information storage materials comprises computer tapes.

* * * * *